US011203851B2

(12) United States Patent
You et al.

(10) Patent No.: US 11,203,851 B2
(45) Date of Patent: Dec. 21, 2021

(54) FOUNDATION REINFORCING APPARATUS USING BRACING-TYPE SUPPORTING STRUCTURE AND LATERAL PRESTRESSING DEVICE AND METHOD OF REINFORCING FOUNDATION USING THE SAME

(71) Applicant: KOREA INSTITUTE OF CIVIL ENGINEERING AND BUILDING TECHNOLOGY, Gyeonggi-do (KR)

(72) Inventors: Young Chan You, Gyeonggi-do (KR); Ki Sun Choi, Gyeonggi-do (KR); Hyun Jee Lee, Incheon (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 90 days.

(21) Appl. No.: 16/616,948

(22) PCT Filed: Sep. 26, 2019

(86) PCT No.: PCT/KR2019/012488
§ 371 (c)(1),
(2) Date: Nov. 25, 2019

(87) PCT Pub. No.: WO2021/002535
PCT Pub. Date: Jan. 7, 2021

(65) Prior Publication Data

US 2021/0207334 A1 Jul. 8, 2021

(30) Foreign Application Priority Data

Jul. 4, 2019 (KR) ..... 10-2019-0080687

(51) Int. Cl.
*E02D 5/54* (2006.01)
*E02D 5/56* (2006.01)
(Continued)

(52) U.S. Cl.
CPC ..... *E02D 5/54* (2013.01); *E02D 5/56* (2013.01); *E02D 27/48* (2013.01); *E04G 23/06* (2013.01); *E02D 2250/0046* (2013.01)

(58) Field of Classification Search
CPC combination set(s) only.
See application file for complete search history.

(56) References Cited

U.S. PATENT DOCUMENTS

2002/0176749 A1* 11/2002 Provost ..... E02D 35/00 405/230
2007/0286688 A1 12/2007 Bradley
(Continued)

FOREIGN PATENT DOCUMENTS

JP 200336402 11/2003

*Primary Examiner* — Kyle Armstrong
(74) *Attorney, Agent, or Firm* — JCIPRNET

(57) ABSTRACT

The present invention relates to a foundation reinforcing apparatus using a bracing-type supporting structure and a lateral prestressing device and a foundation reinforcing method using the same, wherein, in the foundation reinforcement used for remodeling construction that requires an extension of a building such as an apartment, the foundation reinforcing apparatus introduces lateral pre-stressing force into a bracing-type supporting structure to introduce a preloading load to a new pile of a new footing by using an upper supporting plate, which is connected to an existing vertical part and an existing slab, as a reaction bed and allows the new pile to share a load applied before and after the extension of the building so that reinforcement efficiency is increased, and thus construction is performed economically.

11 Claims, 7 Drawing Sheets

(51) Int. Cl.
*E02D 27/48* (2006.01)
*E04G 23/06* (2006.01)

(56) References Cited

U.S. PATENT DOCUMENTS

2016/0333541 A1 11/2016 Murden
2018/0245360 A1* 8/2018 Woodford ..... E04G 23/0229
2018/0363268 A1* 12/2018 Asplin ..... E02D 35/005

* cited by examiner

FOUNDATION REINFORCING APPARATUS USING BRACING-TYPE SUPPORTING STRUCTURE AND LATERAL PRESTRESSING DEVICE AND METHOD OF REINFORCING FOUNDATION USING THE SAME

CROSS-REFERENCE TO RELATED APPLICATION

This application is a 371 of international application of PCT application serial no. PCT/KR2019/012488, filed on Sep. 26, 2019, which claims the priority benefit of Korean application no. 10-2019-0080687, filed on Jul. 4, 2019. The entirety of each of the abovementioned patent applications is hereby incorporated by reference herein and made a part of this specification.

FIELD OF THE INVENTION

The present invention relates to a foundation reinforcing apparatus using a bracing-type supporting structure and a lateral prestressing device and a method of reinforcing a foundation using the same. More specifically, the present invention relates to a foundation reinforcing apparatus using a bracing-type supporting structure and a lateral prestressing device which, in the foundation reinforcement used for a remodeling construction that requires an extension of a building, such as an apartment, introduces lateral pre-stressing force into a bracing-type supporting structure so as to introduce a preloading load to a new pile of a new footing by using an upper supporting plate, which is connected to an existing vertical part and an existing slab, as a reaction bed and allows a new pile to receive a load applied before and after the extension of the building so that reinforcement efficiency is increased, and thus construction is performed economically, and a method of reinforcing a foundation using the same.

DESCRIPTION OF RELATED ART

FIGS. 1*a* and 1*b* are shop drawings illustrating a conventional preloading method.

That is, it can be confirmed that an existing structure includes a footing 1 and a column 2 formed in the center of the footing.

Therefore, a load transferred from the column 2 is transferred to an existing pile 3 through the footing 1.

In this case, when an extension and the like is made on the existing structure, since a load transferred from the column 2 is increased, it is difficult to bear the load with only a bearing capacity of the existing pile 3. Therefore, a new pile 10 is additionally constructed on the footing 1.

Micro-piles, which have a relatively small diameter and are easily constructed, are widely used as the new pile 10. A through hole G2 is formed by passing through the footing 1, and an excavation hole G1 is formed by excavating the ground under the footing 1.

To construct the new pile 10, the micro-piles are inserted into the ground to a predetermined depth, head parts of the micro-piles are anchored to the through hole G1 of the footing 1, and the excavation hole G2 is filled with a filling material.

In this case, the bearing capacity of the micro-piles is maintained by frictional force between external surfaces of the micro-piles and the filling material, but when construction management is not performed properly, it is difficult to secure a required bearing capacity.

In the conventional preloading method, pre-stressing force P (a preload) is applied downward before the head parts of the micro-piles are anchored to the footing 1, and the head parts are anchored to the footing 1, and thus an end bearing capacity and frictional force can be effectively secured.

Therefore, the conventional preloading method necessarily requires a preloading device 20 for applying pre-stressing force downward to the new pile 10 set on the footing 1.

As shown in FIGS. 1*a* and 1*b*, a screw device is installed as the preloading device 20 between a triangular support and the head parts of the micro-piles, and since a screw vertically expands by rotating, pre-stressing force can be applied downward due to a reaction force. To effectively secure the reaction force, a reaction support 30 may be additionally installed between the triangular support and a lower surface of a first floor-slab 5.

FIGS. 1*c* and 1*d* are shop drawings illustrating another conventional preloading method.

That is, in the conventional preloading method, since the new pile 10 is constructed on the footing 1, the footing 1 should have a free space in which the new pile 10 is constructed, and the new pile 10 should effectively receive existing and additional loads transferred from the existing pile 3 and a column.

However, when the footing 1 does not have the free space in which the new pile 10 is constructed, an extension footing 4 is additionally constructed on a lateral side of the footing 1, the new pile 10 is constructed on the extension footing 4, and the extension footing 4 is integrated with the footing 1 so that the extension footing 4 and the footing 1 are moved integrally.

Therefore, while the extension footing 4 and the footing 1 are moved integrally, the existing pile 3 and the new pile 10 share the load transferred from the column.

However, in such a conventional preloading method, a case of loss of downward pre-stressing force (a preload) introduced into the new pile 10 occurs when time elapses, but even when the downward pre-stressing force is additionally introduced, the head parts of the micro-piles are already constructed on the footing 1 to be anchored, as shown in portion A, and thus tasks cannot be performed.

Therefore, a problem occurs in which the load that the existing pile 3 receives is increased more than the existing load due to loss of the preload.

Further, since the new pile 10 is spaced apart from the column 2 more than the existing pile 3, a problem occurs in which an axial load that the extension footing 4 receives is decreased due to deformation of the extension footing 4 and the footing 1. Therefore, in the conventional preloading method, in actuality, a case occurs in which a new pile is additionally installed, and thus economic feasibility is degraded.

BRIEF SUMMARY OF THE INVENTION

Technical Problem

The present invention is directed to providing a foundation reinforcing apparatus using a bracing-type supporting structure and a lateral prestressing device and a method of reinforcing a foundation using the same, wherein, in foundation reinforcement used for remodeling construction for an extension of a building such as apartment, the foundation reinforcing apparatus allows a new pile to share a preloading load as well as an existing load and an extension load before and after the extension by introducing adjustable lateral pre-stressing force so as to ensure economic feasibility when foundation reinforcement is required for remodeling construction of an apartment and the like, and thus a load can be adjusted effectively.

Technical Solution

One aspect of the present invention provides a foundation reinforcing apparatus using a bracing-type supporting structure and a lateral prestressing device, which includes a new footing constructed in the ground, wherein the new footing is not in contact with an existing footing and separate from the existing footing, a bracing-type supporting structure that is spread in two lateral directions from an upper position at which an existing vertical part formed on the existing footing is connected with an existing slab and extends to a lower position of the new footing so as to be formed as an inclined structure, and a lateral prestressing device which is disposed on the new footing and connected with the bracing-type supporting structure, introduces an introduced downward reaction force (V1) of lateral pre-stressing force (V) to a new pile as a preload, and allows an inclined reaction force (V2) of the lateral pre-stressing force (V) to resist an existing load and an extension load transferred from two sides of the bracing-type supporting structure.

Another aspect of the present invention provides a method of reinforcing a foundation using a foundation reinforcing apparatus using a bracing-type supporting structure and lateral prestressing device which includes (a) constructing a new pile in the ground to not be in contact with an existing footing and separate therefrom and then integrating the new pile with a new footing, (b) forming a bracing-type supporting structure in an inclined structure, wherein the bracing-type supporting structure spreads in two lateral directions from an upper position at which an existing vertical part formed on the existing footing is connected with an existing slab and extends to a lower position of the new footing, and (c) installing a lateral prestressing device that is disposed on the new footing and connected with the bracing-type supporting structure so that a downward reaction force (V1) of an introduced lateral prestressing load (V) is introduced to the new pile as a preloading load and allows an inclined reaction force (V2) of the lateral prestressing load (V) to resist an existing load and an extension load transferred from two sides of the bracing-type supporting structure.

Advantageous Effects

According to the present invention, unlike the conventional preloading method, a foundation reinforcing apparatus introduces lateral pre-stressing force into a bracing-type supporting structure so as to introduce a preloading load to a new footing by using an upper supporting plate, which is connected with an existing vertical part and an existing slab, as a reaction bed and allows a new pile to share existing and extension loads using a bracing-type supporting structure, and thus a bearing capacity of the new pile can be secured more efficiently.

In the present invention, new footings are constructed to be separate from the existing footing, and the new footings are connected with an existing vertical part and an existing slab using the bracing-type supporting structure so that a load sharing rate of the new pile is increased when comparing before and after an extension, and thus foundation reinforcement can be efficiently performed due to reduction of new piles to be constructed.

DETAILED DESCRIPTION OF THE INVENTION

Best Modes of the Invention

Figure 1B:
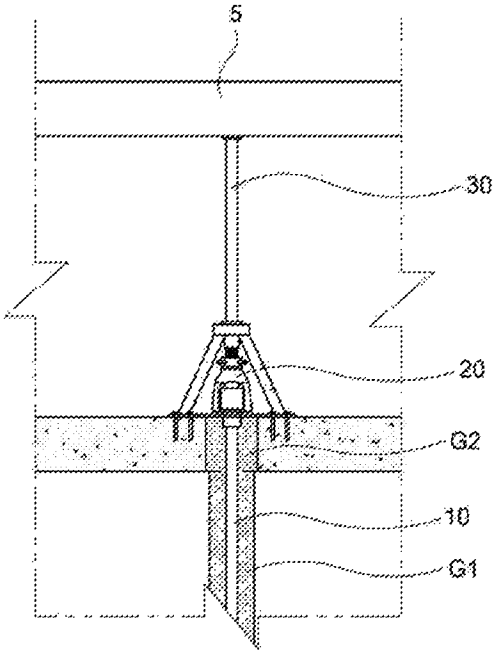
FIGS. 1*a*, 1*b*, 1*c* and 1*d* are shop drawings of conventional preloading methods.
Figure 1A:
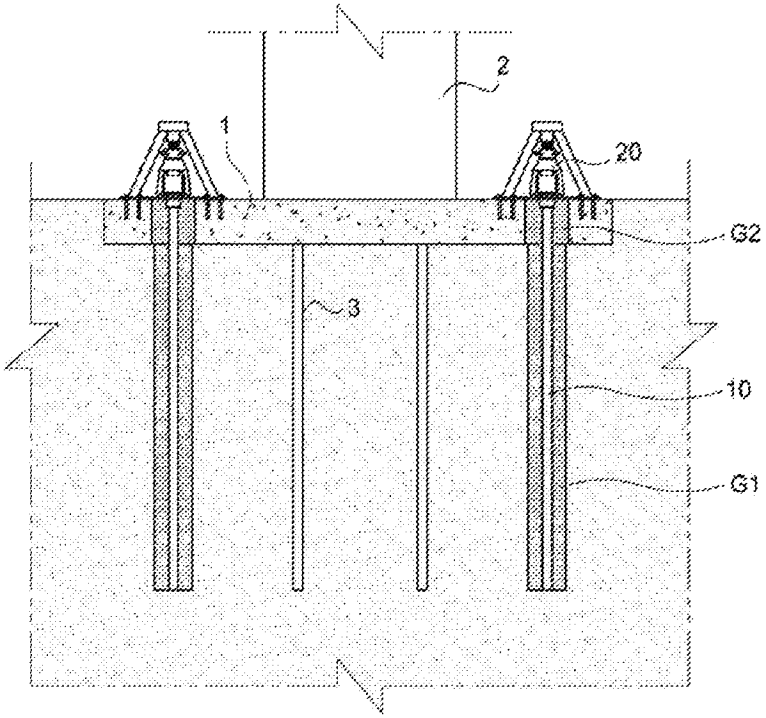
Figure 1D:
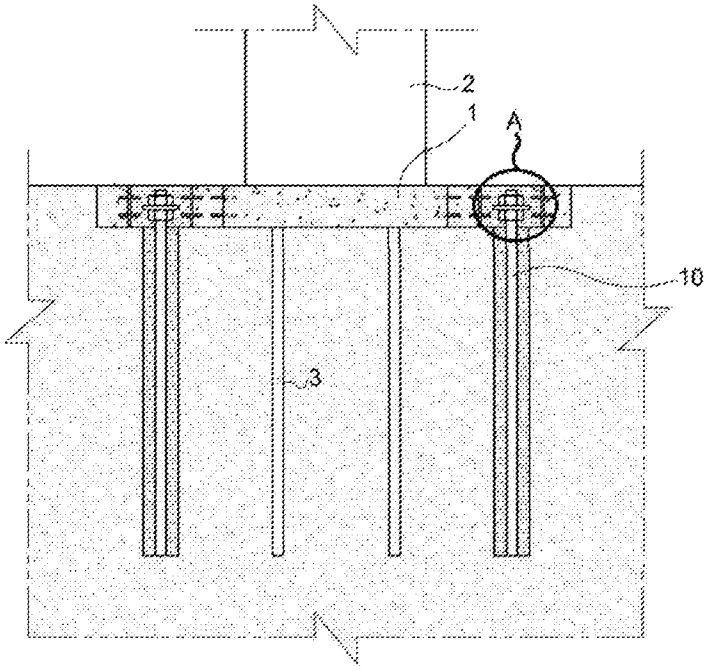
Figure 1C:
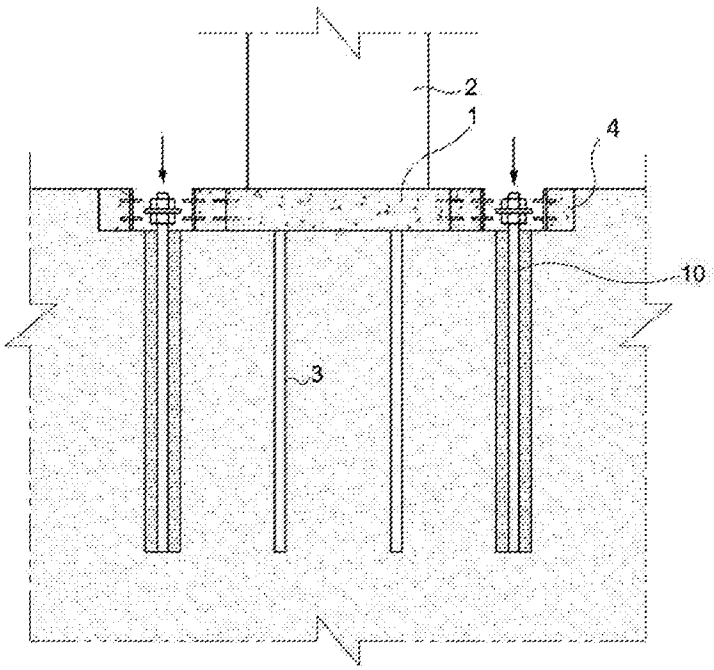

A foundation reinforcing apparatus includes new footings, a bracing-type supporting structure, and a lateral prestressing device, wherein the new footings are constructed in the ground to be separate from and not in contact with an existing footing, the bracing-type supporting structure is spread in two lateral directions from an upper position at which an existing vertical part formed on the existing footing is connected with an existing slab and extends to lower points of the new footings so as to be formed as an inclined structure. The lateral prestressing device is disposed on the new footings and connected with the bracing-type supporting structure, introduces a downward reaction force of lateral pre-stressing force into new piles as a preloading load, and allows an inclined reaction force of the lateral pre-stressing force to resist existing and extension loads transferred from two sides of the bracing-type supporting structure.

MODES OF THE INVENTION

Hereinafter, embodiments that are easily performed by those skilled in the art will be described in detail with reference to the accompanying drawings. However, the embodiments of the present invention may be implemented in several different forms and are not limited to embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element or another element may be further included therein, unless otherwise described.

[Foundation Reinforcing Apparatus 100 Using a Bracing-Type Supporting Structure 140 and a Lateral Prestressing Device 130]

Figure 2:
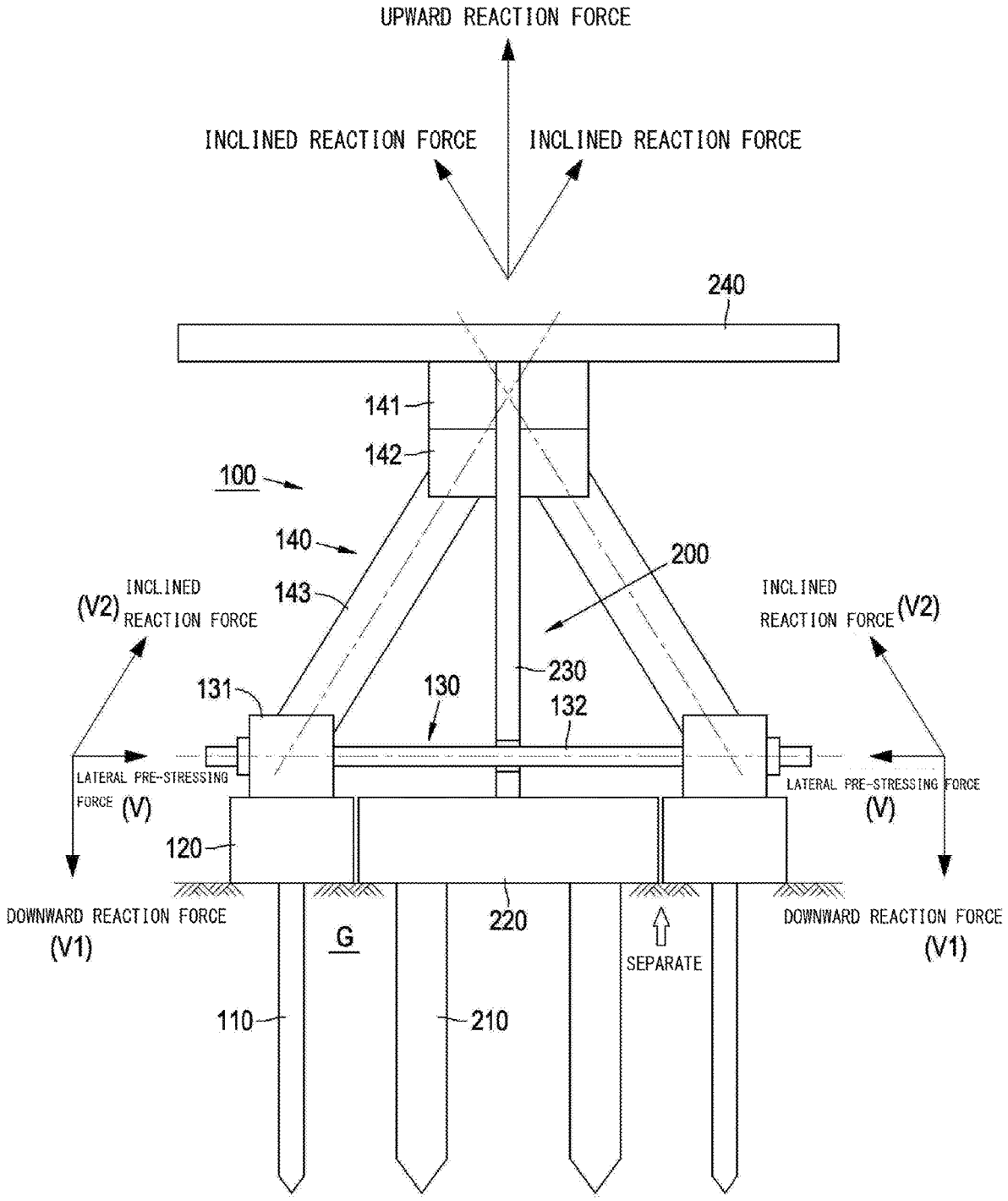
FIG. 2 is a configuration view of a foundation reinforcing apparatus using a bracing-type supporting structure and a lateral prestressing device according to the present invention.

FIG. 2 is a configuration view of the foundation reinforcing apparatus 100 using the bracing-type supporting structure 140 and the lateral prestressing device 130 according to the present invention.

The foundation reinforcing apparatus 100 using the bracing-type supporting structure 140 and the lateral prestressing device 130 introduces lateral pre-stressing force V to introduce an adjustable preloading load using the downward reaction force V1 and uses the bracing-type supporting structure 140 that generates an inclined reaction force V2 that resists existing and extension loads, and new footings 120 are constructed to be separate from an existing footing 220 but are connected with the existing vertical part 230 and the existing slab 240 using the bracing-type supporting structure 140 so that new piles 110 share the existing and extension loads applied before and after an extension.

As shown in FIG. 2, the foundation reinforcing apparatus 100, which uses the bracing-type supporting structure 140 and the lateral prestressing device 130, includes the new piles 110, the new footings 120, the lateral prestressing device 130, and the bracing-type supporting structure 140 that are constructed separately from an existing structure 200, and in this case, the existing structure 200 includes an existing pile 210, the existing footing 220, the existing vertical part 230, and the existing slab 240.

First, as shown in FIG. 2, the new piles 110, which are piles first constructed on the ground under the new footings 120, are separately constructed in the ground G next to the existing footing 220 and usually use micro-piles that are connectable to each other.

The new piles 110 may be constructed in a manner that directly press-fits the micro-piles into the ground under the new footings 120 by rotating or in a manner that forms excavation holes, inserts the micro-piles into the excavation holes, and finishes the excavation holes with a filling material, wherein the plurality of micro-piles are installed to be separate from each other.

Head parts of the new piles 110 are integrated into the new footings 120 described below, and generally, footing concrete is poured at a predetermined thickness on the head parts of the micro-piles so that the head parts of the micro-piles are integrated with the new footings 120.

Next, as shown in FIG. 2, the new footings 120 are footings newly constructed next to the existing footing 220 and are conventionally constructed to be integrated with the existing footing 220, but the new footings 120 are not integrated with and separate from the existing footing 220.

Since the new footings 120 are constructed to not be integrated with but to be separate from the existing footing 220, the new footings 120 and the existing pile 210 are moved independently, and the new piles 110 effectively share the existing and extension loads, which are transferred from the existing slab and the existing vertical part, with the existing pile 210.

That is, in the conventional preloading method, since the new footings 120 are integrated with the existing footing 220, the new footings 120 and the existing footing 220 are moved integrally, and thus a problem occurs in which the existing pile 210 has a load sharing rate higher than that of the new piles 110. However, in the present invention, to solve the problem, the new footings 120 are constructed to be separate from the existing footing 220.

Unlike the conventional case, in the present invention, footing integration construction, in which reinforcement bars are extracted from the existing footing 220, the reinforcement bars are connected with reinforcement bars extracted from the new footing 120, and concrete is poured, is not required, and thus a construction process may be simplified.

Figure 3A:
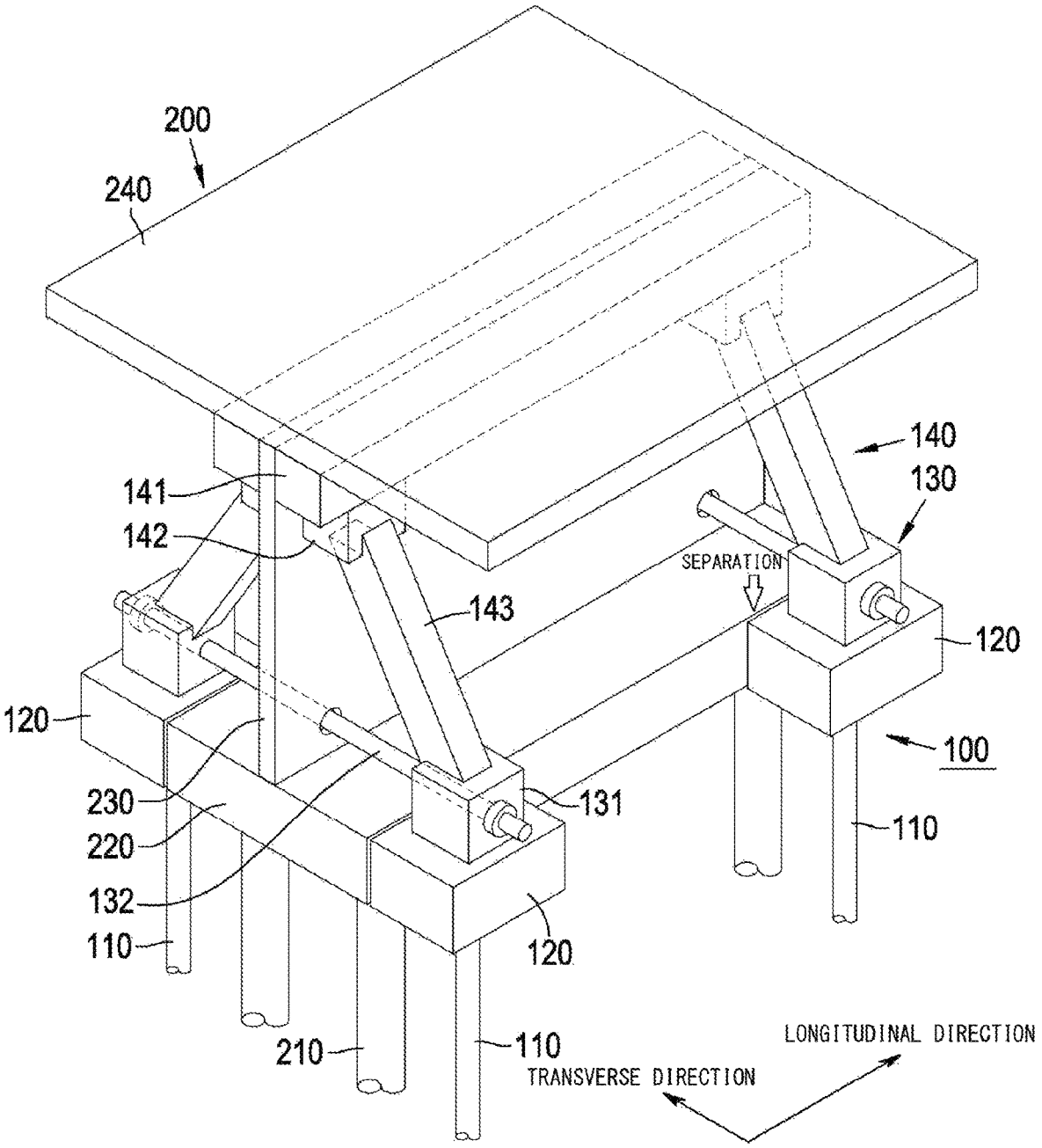
FIGS. 3*a* and 3*b* are views illustrating the foundation reinforcing apparatus using a bracing-type supporting structure and a lateral prestressing device according to the present invention.
Figure 3B:
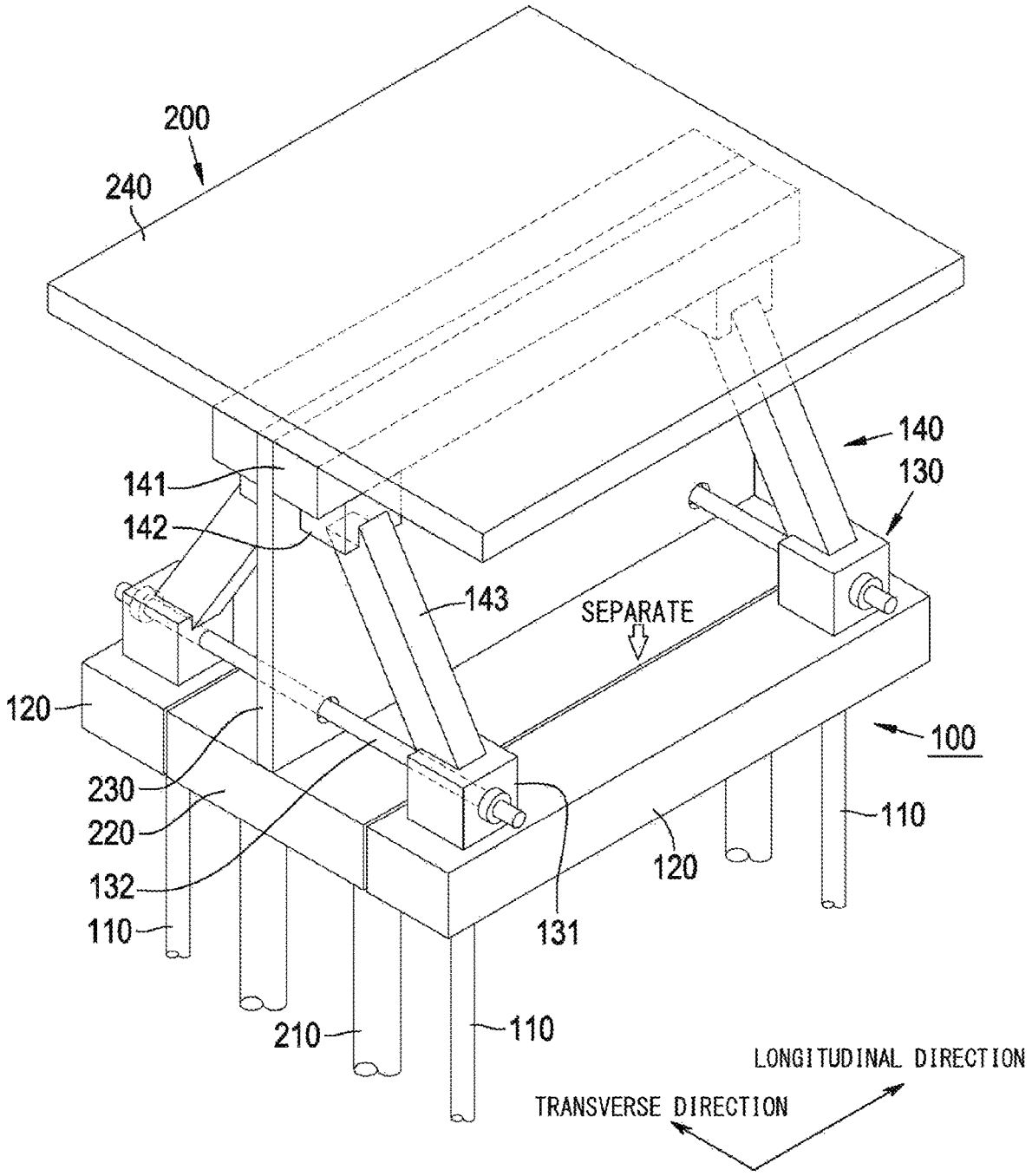

As shown in FIGS. 3*a* and 3*b*, the new footings 120 may be constructed as individually formed footings or constructed as a strip footing extending continuously and are constructed in a manner in which required reinforcement bars are arranged and concrete is poured and cured at a predetermined thickness to be integrated with head parts of the new piles 110.

As shown in FIG. 2, the new footings 120 are symmetrically constructed on both sides of the existing footing 220 and serve to transfer the downward reaction force V1 generated by the lateral prestressing device 130 and the existing and extension loads to the new piles 110 through lower supports 131, wherein the lower supports 131 are connected with lower end portions of the bracing-type supporting structure 140 symmetrically formed on both sides of the existing vertical part 230.

Next, as shown in FIG. 2, the lateral prestressing device 130 is installed on upper surfaces of the new footings 120, allows the lateral prestressing load V to introduce an adjustable preloading load using the downward reaction force V1, and serves to generate the inclined reaction force V2 that resists the existing and extension loads.

That is, the lateral prestressing device 130 serves to introduce the preloading load, that is, the downward prestressing force, serves to introduce the inclined reaction force V2 into the bracing-type supporting structure 140 so that the inclined reaction force V2 actively resists the transferred existing and extension loads, and may adjust the preloading load by repeatedly adding the preloading loads at different times.

As shown in FIG. 2, the lateral prestressing device 130 includes the lower supports 131 and a lateral-prestressing unit 132.

First, as shown in FIG. 2, the lower supports 131 are integrally or separately formed on upper portions of the new footings 120 in an individual block form, basically function as an anchored block, and have lateral through holes so that the lateral-prestressing unit 132 passes therethrough. Therefore, the plurality of lower supports 131 may be integrally formed with upper surfaces of the new footings 120 to be separate in a longitudinal direction.

The lower supports 131 serve to transfer the existing and extension loads and the downward reaction force V1 caused by the lateral prestressing device 130 to the new piles 110.

Therefore, the lower supports 131, which are formed on upper surfaces of the new footings 120 that are symmetrical to each other, are positioned symmetrically with respect to the existing vertical portion 230.

As shown in FIG. 2, the lateral-prestressing unit 132 may use a steel rod, a tendon, or the like and pass through a lateral through hole formed at a lower portion of the existing vertical part 230 so that both end portions thereof pass through the lateral through holes of the lower supports 131 and extend to lateral sides of the lower supports 131.

The lateral-prestressing unit 132 is laterally stressed using a stressing jack, and when end portions of the lateral-prestressing unit 132 are anchored to the lower supports 131, the lateral prestressing load V is introduced.

Therefore, since an approximate middle portion of the lateral-prestressing unit 132 is installed to pass through the lateral through holes formed at the lower portions of the lower supports 131, a lateral state of the lateral-prestressing unit 132 can be effectively maintained due to restriction of the middle portion. When the lateral-prestressing unit 132 is prestressed and anchored, distortion and buckling of the lateral-prestressing unit 132 can be prevented, and thus a prestressing task can be performed more safely.

The lower supports 131 are integrated with the new footings 120, and upper portions of the lower supports 131 are integrated with lower end portions of the bracing-type supporting structure 140, and thus, as shown in FIG. 2, when the lateral prestressing load V is introduced, the downward pre-stressing force, which is the preload, is introduced into the new footings 120 as the downward reaction force V1, and the inclined reaction force V2, which is an inclined pre-stressing force, is introduced in an extension direction of the bracing-type supporting structure 140 as the inclined reaction force V2.

Therefore, in the preloading method, the downward reaction force V1 serves as an adjustable preload, and the inclined reaction force V2 is applied in the opposite direction to the existing and extension loads, which are transferred from the bracing-type supporting structure 140, to offset the existing and extension loads, and thus the foundation reinforcement efficiency can be increased.

Further, since the downward reaction force V1 is adjustable according to the magnitude of pre-stressing force of the lateral-prestressing unit 132, the preloading load applied to the new pile 110 can be adjusted.

Next, as shown in FIG. 2, the bracing-type supporting structure 140, which is a supporting device installed on the existing vertical part 230 and between the existing slab 240 and the lower supports 131 of the lateral prestressing device 130, serves to transfer the existing and extension loads to the lower supports 131, the new footings 120, and the new piles 110, and serves as a transfer path of the inclined reaction force V2 that offsets the existing and extension loads.

To this end, the bracing-type supporting structure 140 is formed as an inclined structure that is spread in two lateral directions (in a transverse direction) from an upper position at which the existing vertical part 230 is connected with the existing slab 240 to transfer the existing and extension loads to the lower portions of the new footings 120, and thus the existing and extension loads can be supported and transferred effectively.

To this end, in the bracing-type supporting structure 140, upper supporting beams 141 are formed at a position as an upper position at which the existing vertical part 230 is connected with the existing slab 240, and braces 143 extending to spread in two lateral directions are formed on lower ends of the upper supporting beams 141, and the lower ends of the braces 143 are integrated with upper surfaces of the above-described lower supports 131.

As shown in FIG. 2, the upper supporting beams 141 are formed at a position as an upper position, at which the existing vertical part 230 is connected with the existing slab 240, to extend in a beam form so as to effectively transfer the load, which is transferred from the existing vertical part 230 and the existing slab 240, downward, and upper surfaces of the upper supporting beams 141 are in contact with the existing slab 240, and one surfaces of the upper supporting beams 141 are in contact with the existing vertical part 230 so that the upper supporting beams 141 are integrated with the existing vertical part 230 and the existing slab 240.

Next, both of the upper supporting beams 141 are formed at positions at which upper end portions of the braces 143 are connected with the upper supporting beams 141 in a beam form extending in a longitudinal direction. Lower surfaces of the both upper supporting beams 141 are connected with upper ends of the inclinedly formed braces 143, and the upper supports 142 are integrated with the lower surfaces of the upper supporting beams 141 in a block form to be connected with the upper end portions of the both braces 143.

Next, the upper end portions of the both braces 143 are connected with the lower surfaces of the both upper supporting beams 141, and the lower end portions of the both braces 143 are connected with the upper surfaces of the both lower supports 131 of the lateral prestressing device 130. When the upper supports 142 are used, the upper end portions of the both braces 143 are connected with the upper supports 142.

That is, upper ends of the braces 143 may be directly connected to the both upper supporting beams 141 without passing through the both upper supports 142.

The braces 143 are formed as concrete members, and the bracing-type supporting structure 140 may be constructed to be integrated with the lower supports 131 of the lateral prestressing device 130 excluding the lateral-prestressing unit 132.

FIGS. 3*a* and 3*b* illustrate a foundation reinforced by the foundation reinforcing apparatus 100 using a bracing-type supporting structure and a lateral prestressing device according to one embodiment of the present invention.

First, in FIG. 3*a*, in the existing structure 200, such as an apartment, a head part of the existing pile 210 is integrated with the existing footing 220, the existing vertical part 230 continuously extends on the existing footing 220 in the longitudinal direction, and the existing slab 240 is formed on an upper surface of the existing vertical part 230.

Therefore, the existing footing 220 and the existing slab 240 may become an underground structure, such as an underground parking lot or a machine room, and when a vertical or lateral extension is built on an upper surface of the existing slab 240, a reaction force of the existing pile 210 may exceed a design bearing capacity.

The new piles 110 are first constructed in the ground next to the existing footing 220 to be separate from each other in a longitudinal direction, and the new footings 120 having a form of individual footings are also constructed on the head parts of the new piles 110 to be separate from each other in a longitudinal direction.

In this case, the new footings 120 are not in contact with lateral sides of the existing footing 220 to be separate from the existing footing 220 so that the loads are not transferred from the existing footing 220 to the new footings 120, and the new footings 120 and the existing footings 220 are moved individually.

Next, the bracing-type supporting structure 140 and the lower supports 131 of the lateral prestressing device 130 are constructed, and the bracing-type supporting structure 140 is integrated with the existing vertical part 230 and the existing slab 240.

The upper supporting beams 141 are formed as beams extending by a predetermined length in a longitudinal direction to correspond to the lower supports 131, and the upper supports 142 are formed as a block integrated with lower portions of the upper supporting beams 141 so that the upper supports 142 are integrated with the upper supporting beams 141.

Therefore, the approximate middle portion of the lateral-prestressing unit 132 of the lateral prestressing device 130 passes through the lateral through hole formed at a lower portion of the existing vertical part 230, and both end portions of the lateral-prestressing unit 132 pass through the lateral through holes of the lower supports 131. When the lateral-prestressing unit 132 is stressed and anchored to the lower supports 131, the lateral prestressing load V is generated.

Since a magnitude of the lateral prestressing load V generated by the lateral prestressing device 130 may be adjusted through adjustment of pre-stressing force, the preloading load can be precisely introduced to the new piles 110, and an additional load may be introduced later on.

Further, since the lateral-prestressing unit 132 of the lateral prestressing device 130 is exposed, performance of maintenance can be facilitated.

In the case of FIG. 3*a*, the existing footing 220 is separate from the new footings 120, the existing footing 220 receives the loads transferred from the existing vertical part 230 and the existing slab 240 as before, and the bracing-type supporting structure 140 is connected with the existing vertical part 230 and the existing slab 240, and thus the existing and extension loads are transferred to the bracing-type supporting structure 140 through the existing vertical part 230 and the existing slab 240 and finally transferred from the bracing-type supporting structure 140 to the new piles 110 through the lower supports 131 of the lateral prestressing device 130 and the new footings 120.

Next, in the case of FIG. 3*b*, differing from FIG. 3*a* in which the new footings 120 are formed as individual footings, the new footings 120 are formed as strip footings.

That is, in the case of FIG. 3*b*, a head part of the existing pile 210 of the existing structure 200, such as an apartment, is also constructed to be integrated with the existing footing 220, the existing vertical part 230 continuously extends on the existing footing 220 in a longitudinal direction, and the existing slab 240 is formed on an upper surface of the existing vertical part 230.

The existing footing 220 and the existing slab 240 may become an underground structure such as an underground parking lot and a machine room, and when a vertical or lateral extension is built on an upper surface of the existing slab 240, a case may frequently occur in which a reaction force of the existing pile 210 exceeds a design bearing capacity.

Therefore, the new piles 110 are first constructed in the ground next to the existing footing 220 to be separate from each other in a longitudinal direction, and the new footings 120 having a strip footing form are continuously constructed on the head parts of the new piles 110 in the longitudinal direction.

In this case, since the new footings 120 are not in contact with lateral sides of the existing footing 220 to be separate therefrom, the load is directly transferred to the new footings 120, and the new footings 120 and the existing footing 220 are moved individually.

The lower supports 131 having a block form are formed on upper surfaces of the new footings 120 to be integrated with or separate from the new footings 120, and when the loads are transferred, the new footings 120 and the lower supports 131 are moved integrally.

The lateral prestressing device 130 is installed on lateral sides of the lower supports 131, and the plurality of lower supports 131 are installed on the new footings 120, which are continuously formed in the longitudinal direction, to be separate from each other.

Next, the bracing-type supporting structure 140 integrated with the existing vertical part 230 and the existing slab 240 is constructed, and the bracing-type supporting structure 140 includes the upper supporting beams 141 and the upper supports 142 formed on lower surfaces of the upper supporting beams 141, wherein upper ends of the braces 143 are connected with the upper supporting beams 141, and lower ends of the braces 143 are connected with the lower supports 131.

In this case, the upper supporting beams 141 are integrated with the existing vertical part 230 and the existing slab 240.

Therefore, the lateral prestressing device 130 passes through a lower portion of the existing vertical part 230 and the lower supports 131 and may transfer the existing and extension loads when being operated.

Further, since the lateral prestressing device 130 is controllable, a preloading load can be precisely introduced, and an additional preloading load can be introduced. The lateral prestressing device 130 may be removed to be replaced with a permanent support and may be remounted for reuse when needed.

In FIG. 3*b*, the existing footing 220 is also separate from the new footings 120 and may receive a load from the existing vertical part 230 and the existing slab 240 as before. Since the bracing-type supporting structure 140 is integrated with the existing vertical part 230 and the existing slab 240, the existing and extension loads are transferred to the bracing-type supporting structure 140 through the existing vertical part 230 and the existing slab 240 and transferred from the bracing-type supporting structure 140 to the new piles 110 through the lower supports 131 of the lateral prestressing device 130 and the new footings 120.

[Method of Reinforcing a Foundation Using the Foundation Reinforcing Apparatus 100 Using a Bracing-Type Supporting Structure and a Lateral Prestressing Device]

Figure 4A:
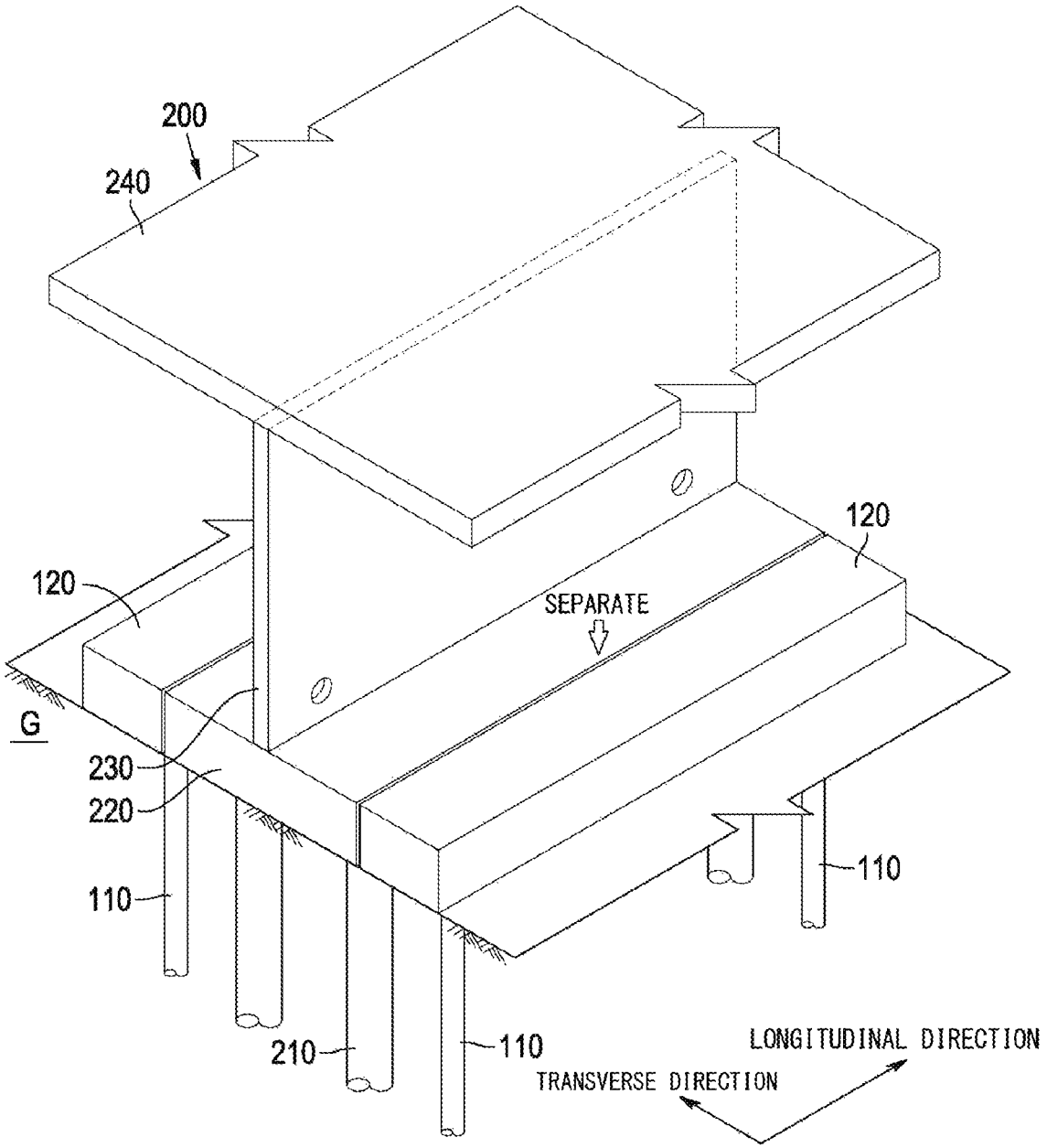
FIGS. 4*a* and 4*b* are views illustrating a process of a method of reinforcing a foundation using the foundation reinforcing apparatus using a bracing-type supporting structure and a lateral prestressing device according to the present invention.
Figure 4B:
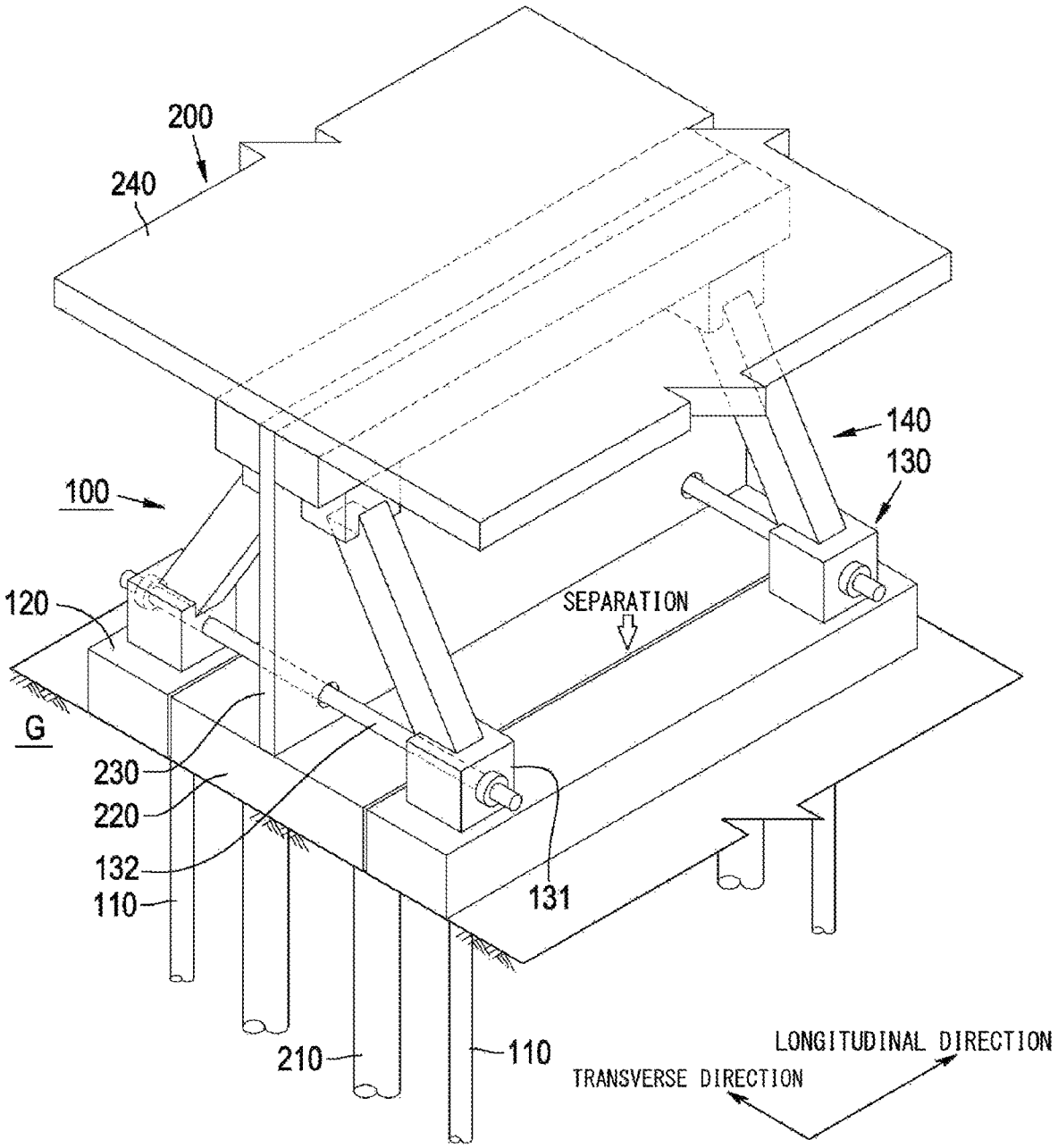

FIGS. 4*a* and 4*b* are views illustrating a process of a method of reinforcing a foundation using the foundation reinforcing apparatus using a bracing-type supporting structure and a lateral prestressing device according to the present invention.

First, the foundation reinforcing apparatus 100 using a bracing-type supporting structure and a lateral prestressing device, which is constructed when an extension of an existing structure 200 is built, is constructed in a method in which new footings 120 are constructed to be separate from an existing footing 220, the bracing-type supporting structure 140 is connected to the existing vertical part 230 and the existing slab 240, and a preloading load is introduced to the new piles 110 using the lateral prestressing device 130 as a reaction force.

As shown in FIG. 4*a*, the existing structure 200 including the existing pile 210, the existing footing 220, the existing vertical part 230, and the existing slab 240 is constructed in advance.

Therefore, the existing pile 210 receives the existing load transferred from the existing vertical part 230 and the existing slab 240, and when an extension of the existing structure, such as an apartment, is built, lateral and vertical extensions are made, and thus the existing and extension loads cannot be safely supported on only the existing pile 210 and the existing footing 220.

As shown in FIG. 4*a*, the new piles 110 are constructed in the ground next to the existing footing 220 to be separate from each other in a longitudinal direction.

Micro-piles are used as the new piles 110 and may be constructed to a predetermined depth, but front end portions of the micro-piles may be supported on a hard bearing layer.

Since the micro-pile has a predetermined length, the micro-piles may be connected by a coupler when needed. The micro-piles may be pressed-fitted into the ground by rotating according to a site condition or inserted into excavation holes and the excavation holes may be filled with a filling material for finishing.

Concrete is poured at a predetermined thickness on arranged reinforcement bars so that the head parts of the micro-piles are buried, and thus the new footings 120 are formed. In FIG. 4*a*, the new footings 120 are constructed as a strip footing but may be constructed as individual footings in a longitudinal direction.

The new footings 120 are not in contact with the existing footing 220 to be separate therefrom, and thus the new footings 120 and the existing footing 220 are moved individually.

Next, the lower supports 131 further integrally formed with upper portions of the new footings 120 or additionally installed thereon are used so that a preloading load by operation of the lateral prestressing device 130 is distributed in downward and inclined directions and transferred to the new footings 120.

As shown in FIG. 4*b*, the bracing-type supporting structure 140 is integrally formed with the existing vertical part 230 and the existing slab 240 of the existing structure 200.

In the bracing-type supporting structure 140, an upper support 142 having a block form is formed at a position at which the existing vertical part 230 is connected with the existing slab 240 as an upper portion, and both braces 143 extend from lower ends of the both upper supporting beams 141 to spread in two lateral directions. Lower ends of the both braces 143 are integrally formed with upper surfaces of the above-described both lower supports 131.

A lateral-prestressing unit 132 of the lateral prestressing device 130 is installed between the bracing-type supporting structure 140 and the lower supports 131 on the new footings 120.

When the lateral prestressing device 130 is operated, the existing vertical part 230, the existing slab 240, and the bracing-type supporting structure 140 serve as a reaction bed, and thus the preloading load is introduced to the new piles 110.

When needed, the lateral prestressing device 130 is re-operated so that the preloading load may be added, or the preloading load to be lost may be restored later on.

Therefore, when construction of an extension is completed, the existing and extension loads are applied. Since the existing footing 220 is separate from the new footings 120, the existing pile 210 also receives a part of the existing and extension loads, and the remaining existing and extension loads are transferred to the new piles 110, and thus a load can be efficiently shared. When a reaction force of the existing pile exceeds a design bearing capacity, an additional preloading load can be introduced into the new piles, and thus the existing pile can be effectively reinforced through adjustment of the preload.

The above description is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims and encompasses all modifications or alterations derived from meanings, the scope and equivalents of the appended claims.

What is claimed is:

1. A foundation reinforcing apparatus, using a bracing-type supporting structure and a lateral prestressing device, wherein the foundation reinforcing apparatus comprises:

a new footing constructed in the ground, wherein the new footing is not in contact with an existing footing and separate from the existing footing;

a bracing-type supporting structure that is spread in two lateral directions from an upper position at which an existing vertical part formed on the existing footing is connected with an existing slab and extends to a lower position of the new footing so as to be formed as an inclined structure; and a lateral prestressing device which is disposed on the new footing and connected with the bracing-type supporting structure, introduces a downward reaction force of lateral pre-stressing force to a new pile as a preload, and allows an inclined reaction force of the lateral pre-stressing force to resist an existing load and an extension load transferred from two sides of the bracing-type supporting structure, wherein the lateral prestressing device comprises a plurality of lower supports being formed on upper surfaces of the new footing and another new footing identical to the new footing, the plurality of lower supports are symmetrical with respect to the existing vertical part, the plurality of lower supports have lateral through holes through which a lateral-prestressing unit passes, and the plurality of lower supports are integrally formed with upper surfaces of the new footing and the another new footing to be spaced apart from each other in a longitudinal direction.

2. The foundation reinforcing apparatus of claim 1, wherein the new pile is pressed-fitted into the ground next to the existing footing by rotating or is inserted into an excavation hole, wherein the new pile has a head part integrally buried in the new footing and is provided as a plurality of new piles spaced apart from each other in a longitudinal direction.

3. The foundation reinforcing apparatus of claim 2, wherein the new footing is provided as a plurality of new footings that are formed in the ground as individual footings being spaced apart from each other in the longitudinal direction or are formed in the ground as a strip footing continuously extending in the longitudinal direction.

4. The foundation reinforcing apparatus of claim 1, wherein the lateral prestressing device further comprises the lateral-prestressing unit that passes through a lateral through hole formed in a lower portion of the existing vertical part and has both end portions that pass through the lateral through holes of the lower supports, extend to lateral sides of the lower supports, and are stressed and anchored.

5. The foundation reinforcing apparatus of claim 1, wherein the bracing-type supporting structure comprises:

both upper supporting beams formed on a portion as an upper position at which the existing vertical part is connected with the existing slab; and braces that extend from lower ends of the upper supporting beams to spread in two lateral directions, wherein lower end portions of the braces are integrated with upper surfaces of lower supports formed on upper surfaces of the new footing and the another new footing.

6. The foundation reinforcing apparatus of claim 5, wherein, in the bracing-type supporting structure, upper supports are further formed as a block to be integrated with lower surfaces of the both upper supporting beams and are connected with upper end portions of the braces.

7. A method of reinforcing a foundation, using a foundation reinforcing apparatus using a bracing-type supporting structure and lateral prestressing device, wherein the method of reinforcing a foundation comprises:

(a) constructing a new pile in the ground being not in contact with an existing footing and being separate from the existing footing, and then integrating the new pile with a new footing;

(b) forming a bracing-type supporting structure in an inclined structure, wherein the bracing-type supporting structure spreads in two lateral directions from an upper position at which an existing vertical part formed on the existing footing is connected with an existing slab and extends to a lower position of the new footing; and (c) installing a lateral prestressing device that is disposed on the new footing and connected with the bracing-type supporting structure so that a downward reaction force of a lateral prestressing load is introduced to the new pile as a preloading load and allows an inclined reaction force of the lateral prestressing load to resist an existing load and an extension load transferred from two sides of the bracing-type supporting structure, wherein, in operation (c), the lateral prestressing device comprises a plurality of lower supports and a lateral-prestressing unit, wherein the plurality of lower supports are formed on upper surfaces of the new footing and another new footing identical to the new footing, the plurality of lower supports are symmetrical with respect to the existing vertical part, the plurality of lower supports have lateral through holes formed so that the lateral-prestressing unit passes therethrough, the plurality of lower supports are formed on the upper surfaces of the new footing and the another new footing to be spaced apart from each other in a longitudinal direction, and the lateral-prestressing unit passes through a lateral through hole formed in a lower portion of the existing vertical part, has both end portions that pass through the lateral through holes of the lower supports, extends in two lateral directions of the lower support, and is stressed and anchored.

8. The method of reinforcing a foundation of claim 7, wherein the new pile in operation (a) is provided as new piles spaced apart from each other and constructed through a method in which a micro-pile is directly press-fitted into the ground under a portion, at which the new footing is formed, by rotating or through a method in which an excavation hole is excavated, the micro-pile is inserted into the excavation hole, and the excavation hole is finished.

9. The method of reinforcing a foundation of claim 7, wherein, in operation (c), the lateral prestressing device repeatedly adds a preloading load at different times using the lateral-prestressing unit to adjust the preload.

10. The method of reinforcing a foundation of claim 7, wherein, in operation (b), the bracing-type supporting structure comprises:

both upper supporting beams formed on a portion as an upper position at which the existing vertical part is connected with the existing slab;

both braces that extend from both sides of the both upper supporting beams to spread in two lateral directions; and upper supports formed as a block and integrated with lower surfaces of the both upper supporting beams, wherein lower end portions of the braces are integrated with upper surfaces of the lower supports formed on upper surfaces of the new footing and the another new footing.

11. The method of reinforcing a foundation of claim 10, wherein the bracing-type supporting structure is formed as a concrete member and integrated with the lateral prestressing device excluding the lateral-prestressing unit.

* * * * *